US005226625A

United States Patent [19]

Hanna

[11] Patent Number: 5,226,625

[45] Date of Patent: Jul. 13, 1993

[54] CONTAINER MOUNTING SYSTEM

[75] Inventor: Emmanuel A. Hanna, Lakeview Terrace, Calif.

[73] Assignee: Bobrick Washroom Equipment, Inc., North Hollywood, Calif.

[21] Appl. No.: 740,051

[22] Filed: Aug. 5, 1991

[51] Int. Cl.[5] ..... F16M 13/00

[52] U.S. Cl. ..... 248/222.1; 248/224.1; 248/224.2

[58] Field of Search ..... 248/222.1, 221.3, 221.4, 248/223.4, 224.1, 224.2, 225.1

[56] References Cited

U.S. PATENT DOCUMENTS

| | | | |
|---|---|---|---|
| 813,537 | 2/1906 | Townsend | 248/221.3 |
| 846,022 | 3/1907 | Ficener | 248/221.3 |
| 2,732,159 | 1/1956 | Connors et al. | 248/224.1 |
| 4,132,380 | 1/1979 | Pastore | 248/224.1 |
| 5,035,389 | 7/1991 | Wang | 248/224.2 X |

FOREIGN PATENT DOCUMENTS

| | | | |
|---|---|---|---|
| 787194 | 12/1957 | United Kingdom | 248/224.3 |

*Primary Examiner*—Alvin C. Chin-Shue

*Attorney, Agent, or Firm*—Harris, Kern, Wallen & Tinsley

[57] ABSTRACT

In the preferred embodiment, a fluid dispenser having a container, a mounting bracket, a latch and a lid. The container and bracket have first interengaging members for supporting the container on the bracket and second interengaging members for maintaining the container on the bracket, the lid and bracket have third interengaging members for pivotally mounting the lid on the bracket with pivot pins on the lid and pivot slots on the bracket for forward movement and upward pivoting of the lid relative to the bracket and container. The lid and container have fourth interengaging members for holding the lid in a closed position on the container, and the lid and bracket have fifth interengaging members for maintaining the lid in the closed position on the container when the latch is in the latched position. The latch preferably is formed integral with the bracket as a single component. An alternative embodiment with a pivoted cover for the container.

19 Claims, 5 Drawing Sheets

CONTAINER MOUNTING SYSTEM

BACKGROUND OF THE INVENTION

This invention relates to mounting systems for containers. In the preferred embodiments illustrated, the containers are dispensers for fluids such as soaps and lotions; however the system is also suitable for use with containers for other products. The specific embodiments disclosed provide for flush mounting of containers on a wall or other support surface.

Push type dispensers have been widely used for many years and two more recent designs are shown in U.S. Pat. Nos. 4,949,877 and 4,964,544. Other designs are shown in the references cited in these two patents.

While the dispensing operation per se has been relatively satisfactory in prior designs, problems are encountered in mounting, refilling, damage in operation and due to vandalism, lost parts, unsightly appearance, cleaning and maintenance of the dispenser.

It is an object of the present invention to provide a new mounting system for containers such as dispensers, which system has a clean and attractive appearance, which does not require removal of any parts for refilling, does not have any exposed components which are easily broken nor any exposed connectors, which is flush mounted on a wall while being easily removed and replaced, is readily cleaned and maintained, has very few parts, and can be locked to avoid vandalism.

Other objects, advantages, features and results will more fully appear in the course of the following description.

SUMMARY OF THE INVENTION

The preferred embodiment of the mounting system includes a container, a mounting bracket, and a latch carried on the bracket. Preferably the container and bracket include first interengaging members for supporting the container on the bracket, and the container and latch include second interengaging members for maintaining the container on the bracket. Preferably the latch is formed integral with the bracket as a single component.

The preferred embodiment also includes a lid for the container, with the lid and bracket having third interengaging members for pivotally mounting the lid on the bracket, and with the lid and container having fourth interengaging members for holding the lid in a closed position on the container.

Further in the preferred embodiment the latch has a T shape with a stem and a cross bar at the upper end of the stem and with the latch joining the bracket at the lower end of the stem for movement of the latch relative to the bracket, with the stem including a stem spring for urging the latch to a latched position engaging the container. A key may be positioned in the bracket for moving the latch away from the latched position for releasing the container from the bracket.

The third interengaging members may include pivot pins on the lid and pivot slots on the bracket for forward movement and upward pivoting of the lid relative to the bracket and container. The fourth interengaging members may include lid lips at the forward end of the lid and lid lip slots on the container for receiving the lid lip means, and with the lid and bracket having fifth interengaging members for maintaining the lid in the closed position on the container when the latch is in the latched position.

In an alternative embodiment, a hinged cover is used instead of a lid, with the cover enclosing the container and pivoting downward to provide access to the container. The container may be removable from the mounting bracket or may be fixed to the mounting bracket, as desired.

DESCRIPTION OF THE PREFERRED EMBODIMENTS

Figure 1:
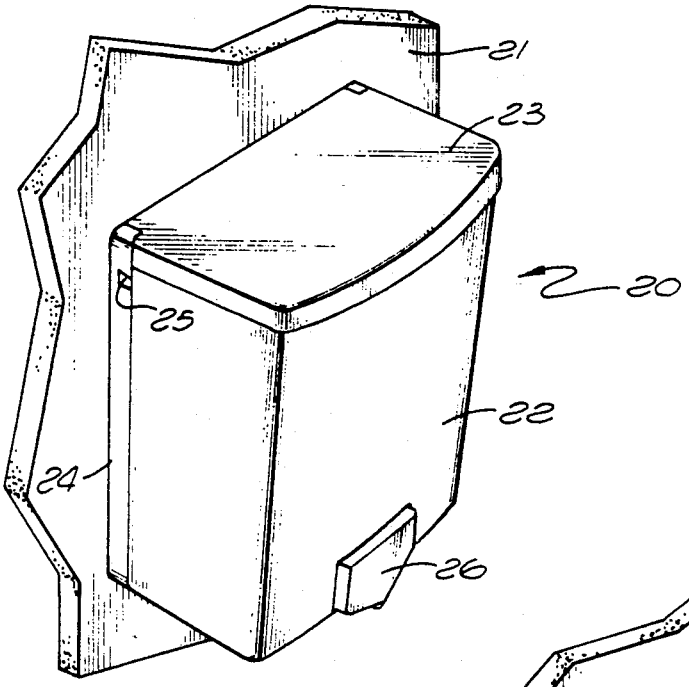
FIG. 1 is a perspective view of the presently preferred embodiment of the invention shown mounted on a wall.

In the mounting system of the invention, a housing is carried on a bracket and a latch mechanism provides for maintaining the housing in a closed position on the bracket. In one form, the housing is a container which is readily installed on and removed from the bracket, with the latch on the bracket and engaging the container. In another form, the housing is a cover for a container, with the container carried on the bracket and with the cover movable to enclose the container and engaging the latch on the bracket.

In the embodiment of FIGS. 1–10, a dispenser 20 is shown mounted on a wall 21 and includes a container 22, a lid 23, a mounting bracket 24, and an optional key 25. A push-in dispenser valve 26 is installed at the bottom of the container.

Figure 2:
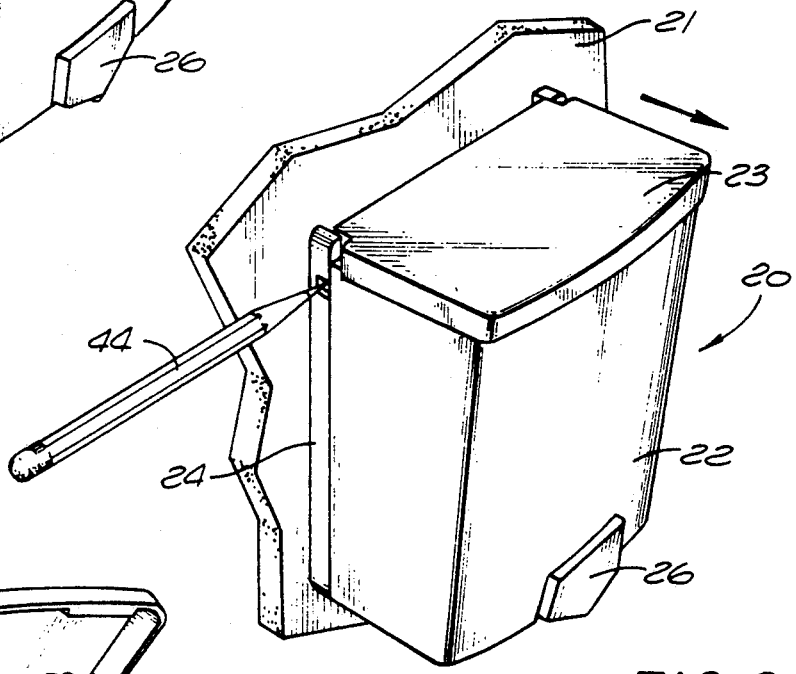
FIG. 2 is a view similar to that of FIG. 1 illustrating the operation in releasing the lid for filling the container of the dispenser.
Figure 3:
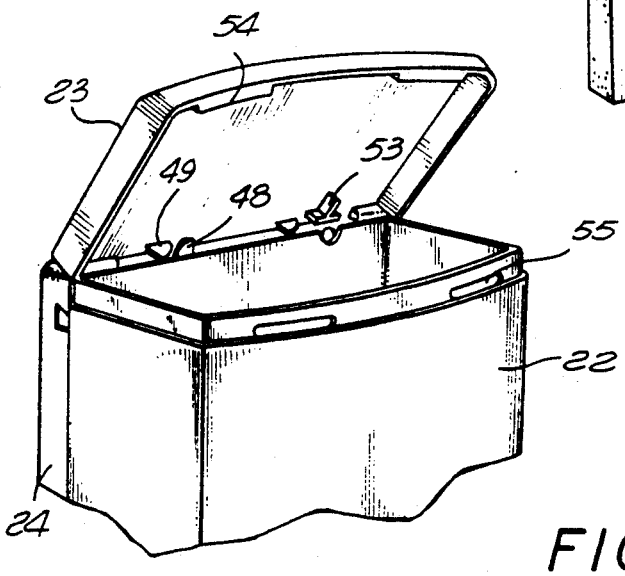
FIG. 3 is a partial view similar to that of FIG. 2 showing the lid in the partially open position.
Figure 4:
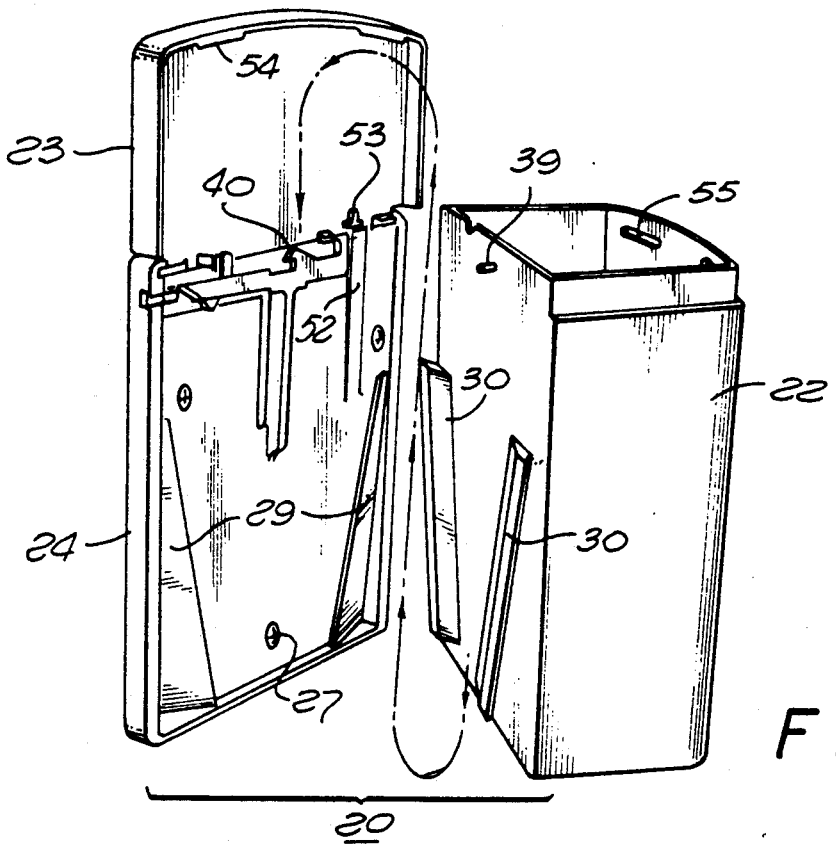
FIG. 4 is a view similar to that of FIGS. 1–3 showing the lid in the open position and the container removed from the mounting bracket.
Figure 5:
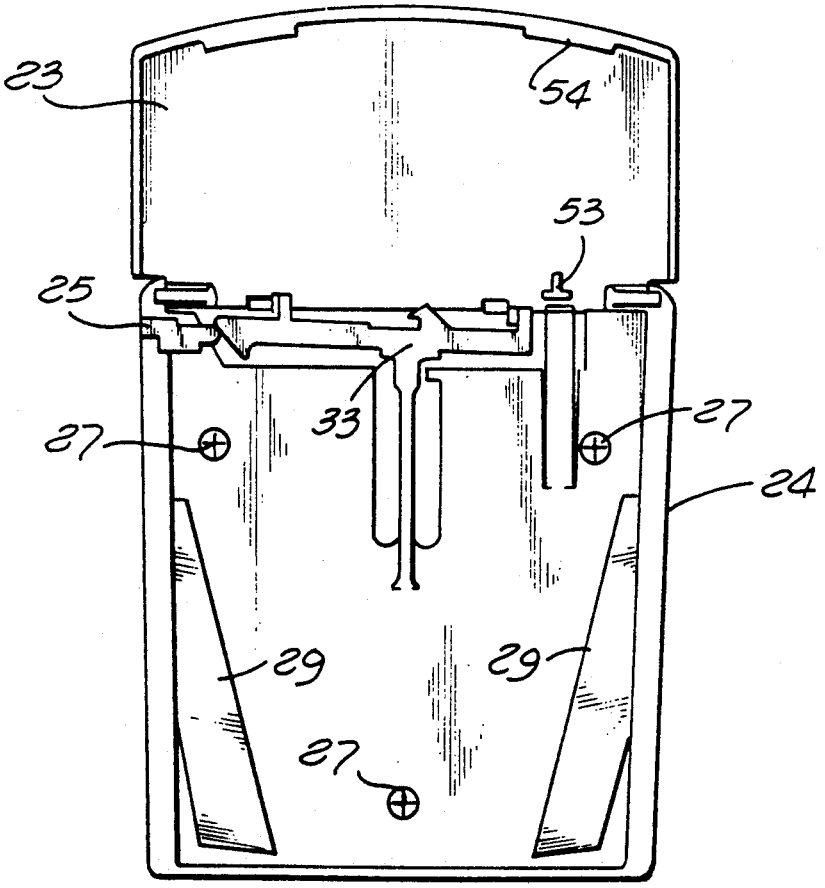
FIG. 5 is a front view of the mounting bracket and lid with the container removed.

The lid 23 is pivotally mounted on the mounting bracket 24 in a manner to be described. The lid pivots from a lid closed position as shown in FIGS. 1 and 2 to a lid open position as shown in FIGS. 4 and 5. When the lid is open, the container can be filled. Also, the container can be removed from the mounting bracket for cleaning and/or servicing.

Typically the mounting bracket is attached to the wall by screws 27 passing through openings 28 in the mounting bracket. Wings 29 are formed on the mounting bracket 24 defining a tapered opening for slidingly receiving wedges 30 formed on the container 22. This arrangement permits sliding insertion of the container into the bracket, with the container moving downward. The wings also may have a tapered cross-section. The taper on the contact surface with the container wedges causes the container to be pulled or drawn towards the bracket as the container is moved downward, in addition to being supported by the bracket. This arrangement eliminates any movement or slop of the container in the horizontal direction. The container may be removed from the bracket and inserted into the bracket when the lid is in the open position of FIGS. 4 and 5. When the container is in position in the bracket as shown in FIG. 1, the lid may be closed, locking the container in place and with the lid also locked in place in a manner to be described.

Figure 6:
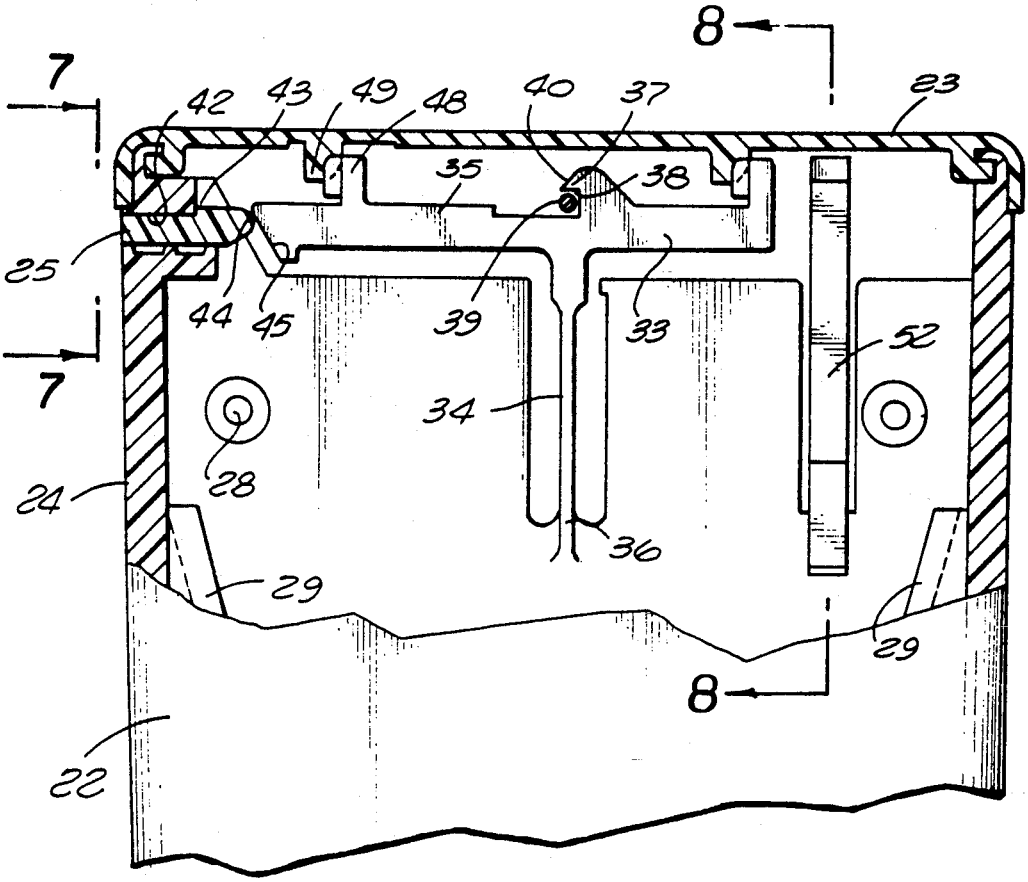
FIG. 6 is an enlarged partial front view, partly in section, showing dispenser of FIG. 1 in the lid closed position.

A latch 33 is carried on the mounting bracket 24 and preferably is formed integrally with the mounting bracket. The latch is generally T shaped, with a vertical stem 34 and a horizontal cross bar 35 at the upper end of the stem, with the lower end 36 of the stem connected to the mounting bracket. A stop finger 37 of the latch forms a notch 38 for receiving a latch pin 39 carried on the container 22. When the container is slid downward into the mounting bracket as previously described, the latch pin 39 engages a cam face 40 of the finger 37 and urges the latch to the right permitting the latch pin to move downward past the finger. When the pin is in the notch 38, the latch returns to its normal position as shown in FIG. 6. The stem 34 of the latch functions as a cantilever spring, urging the latch to the latched position of FIG. 6.

Figure 9:
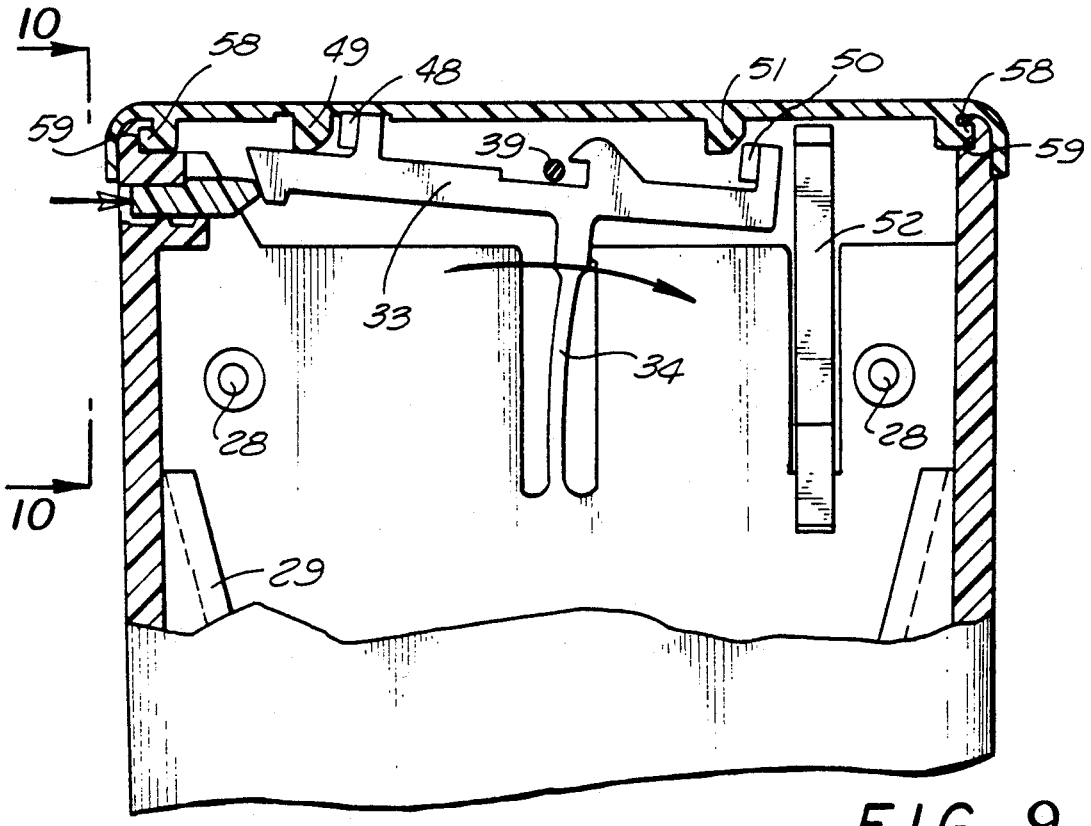
FIG. 9 is a view similar to that of FIG. 7 showing the latch moved to the unlatched position.

In the embodiment illustrated, the key 25 slides in a horizontal slot 42 and is retained by interengaging shoulders at 3 preventing the key from falling out of the mounting bracket. Inward pressure on the key, such as by a pencil 44 shown in FIG. 2, moves the key inward against the action of the spring 34 and moves the latch 35 to the right in an arcuate motion, as shown in FIG. 9. This releases the latch pin 39 from the notch 38 and permits upward movement of the container relative to the mounting bracket. In the preferred embodiment illustrated, the inner end 44 of the key is rounded and engages a sloping face 45 of the latch for improved sliding engagement of the two components. In an alternative embodiment, the key 25 may be omitted, and the latch may be actuated by a rod or other tool, such as a screwdriver.

Figure 7:
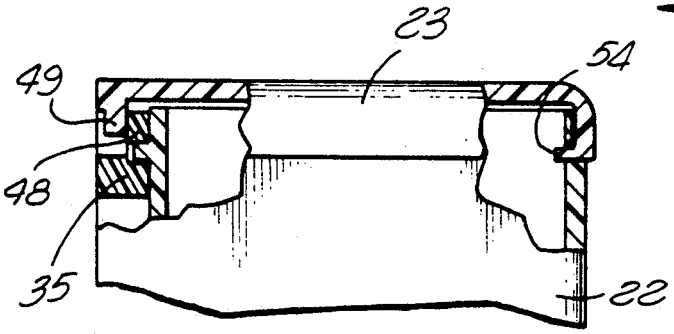
FIG. 7 is a partial sectional view taken along the line 7—7 of FIG. 6.
Figure 8:
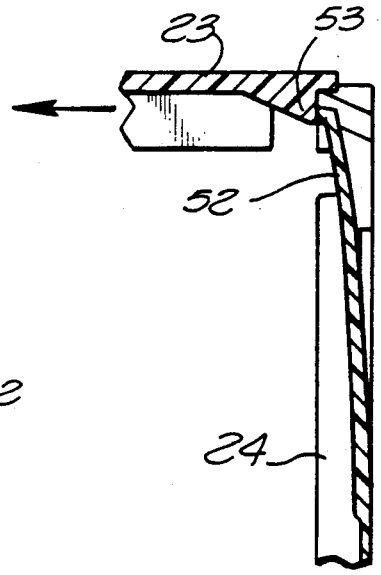
FIG. 8 a partial sectional view taken along the line 8—8 of FIG. 6.

Latch tabs 48 project upward from the cross bar 35 of the latch and engage lid tabs 49 projecting downward from the inner surface of the lid. When the lid is closed as shown in FIGS. 6 and 7, the latch tabs 48 are in front of the lid tabs 49 and prevent forward movement of the lid.

When the latch is pivoted to the right as shown in FIG. 9, the latch tabs are moved away from the lid tabs. In the preferred construction, the latch tabs have a tapered or camming surface 50 and the lid tabs have a tapered or camming surface 51 which enable the lid tabs to move the latch tabs to the right when the lid is pushed to the rear. When the lid tabs clear the latch tabs, the latch is pivoted back to the latched position of FIG. 6 by the action of the spring stem 34.

A lid spring 52 is carried on the mounting bracket and preferably is formed integrally with the mounting bracket. In the preferred embodiment, the mounting bracket is a molded plastic part with the latch 33 and lid spring 52 molded integrally. The upper end of the lid spring engages a spring tab 53 of the lid, best seen in FIG. 8. The lid spring functions as a pop-out spring for urging the lid forward away from the mounting bracket when the lid tabs are released from the latch tabs.

In the preferred embodiment, lid lips 54 are provided at the forward edge of the lid and are positioned in lid slots 55 in the container for retaining the lid in place on the container. In the closed position, the lid lips are maintained in place by preventing the lid from moving forward. Any forward movement is prevented by engagement of the lid tabs behind the latch tabs. The lid is released by freeing the lid tabs, as when the latch tabs are moved to the right, allowing the lid spring to push the lid forward, moving the lips out of the slots from the position of FIG. 7 to the position of FIG. 10. This permits upward pivoting of the lid from the horizontal position to the vertical position.

Figure 10:
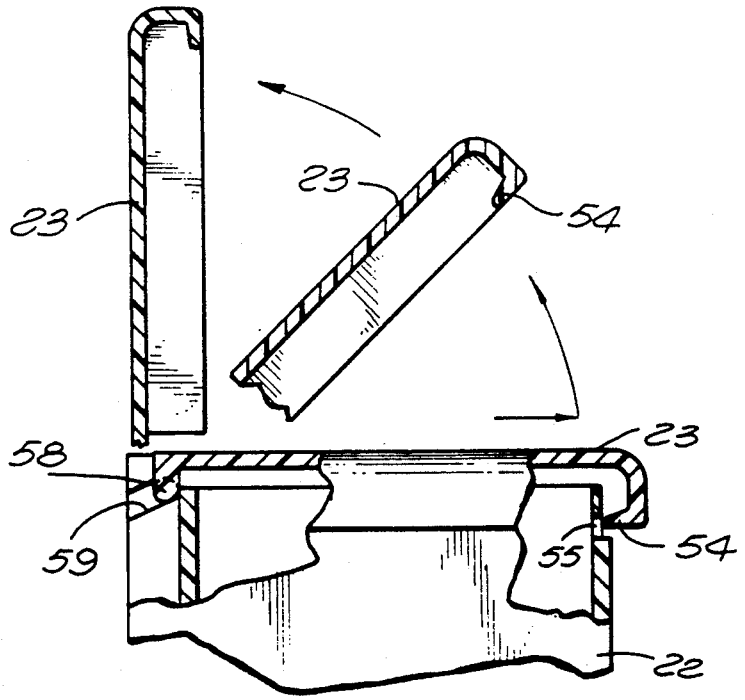
FIG. 10 is a view similar to that of FIG. 7 showing the movement of the lid from the closed position to the open position.

The lid is hinged to the mounting bracket. In the preferred embodiment, pivot pins 58 are formed on the lid and ride pivot slots 59 in the mounting bracket. The slots 59 may extend forward in an upward direction, as best seen in FIG. 10. With this arrangement, the pivot pins 58 are at the lower end of the pivot slots 59 when the lid is fully closed, with the lid lips 54 in the lid slots 55 and with the rear end of the lid flush with the rear side of the mounting bracket, as seen in FIG. 7. When the latch releases the lid, the lid may move forward, releasing the lid lips from the lid slots, and also moving the rear end of the lid away from the wall so that the lid may freely pivot upward to the vertical open position of FIG. 10. The upward movement of the lid produced by the upwardly angled pivot slots reduces the contact between the flanges of the lid and the sides of the container, reducing friction and making the movement of the lid easier. When the pivot pins are at the lower end, there is more bracket material above them to provide stronger support and reduce the likelihood of breaking of the bracket top.

Features and advantages of the mounting system include the following.

The lid swings up and remains attached to the mounting bracket to prevent loss of the lid. In the lid closed position, the lid is prevented from swinging up by engaging the container front at two locations with large contact areas. This dual contact is better than a single point engagement where the lid would be unstable and could "wiggle" out. The lid pivot pins are engaged at the rear in the mounting bracket, also preventing the lid from being lifted up.

In the closed position there is practically no gap between the rear edge of the lid and the wall. This is an important esthetic feature. Also in the closed position, the lid is prevented from sliding forward, and therefore being released, by engaging the lid and bracket at two points, one on each side of the center line. This arrangement prevents accidental or undesirable release, as by moving the lid sideways and "wiggling" it out of the lock.

To release the lid, an unobtrusive opening on the side of the bracket, near the mounting wall, is equipped with a sliding, self contained key. This design separates the locking mechanism from the container, with the moving parts incorporated in the bracket on the wall. Pushing on the key or on the latch causes the lid to automatically move forward, in addition to releasing the lid locking tabs. This feature eliminates any uncertainty on the part of the maintenance people as to how to open the lid. The lid moves forward to unlock its lips from the container. The built-in pop-out spring eliminates any requirement for manual movement while the key is being pressed in.

The latch which holds the lid in the closed position and prevents forward movement of the lid, also holds the container from moving upward. If the container was moved upward when the lid was not open, the container would hit on the lid, with the likelihood of causing parts of the lid to break, particularly the pivot pins.

The stop finger is moved away when the lid is opened, and remains away while the lid is open. When the latch is moved releasing the latch pin, the container may be removed for cleaning or maintenance, without taking the bracket off the wall.

The rear of the container keeps the lid pivot pins in place in the bracket pivot slots. Removing the container from the bracket enables the lid to be removed from the bracket. Such removal enables cleaning of the lid, along with the container, and assembling of the lid to the bracket after mounting the bracket to the wall. If the lid is not removable from the front of the bracket, the installer would have to handle two parts, the bracket and the lid, while he is installing the screws in the wall for the bracket. The feature of a removable lid makes the installation of the dispenser much easier.

While the lid moves automatically forward when released, its pivot pins also move slightly upward on an angle, reducing possible friction between the lid and container sides, and also providing more clearance between the lid rear edge and the bracket. This clearance enables the lid to rotate a full 90°. A lower pivot position will cause the lid edge to hit the bracket surface and not complete the rotation.

Except for the optional key, all these features are accomplished with only three parts, the bracket, container, and lid.

Figure 11:
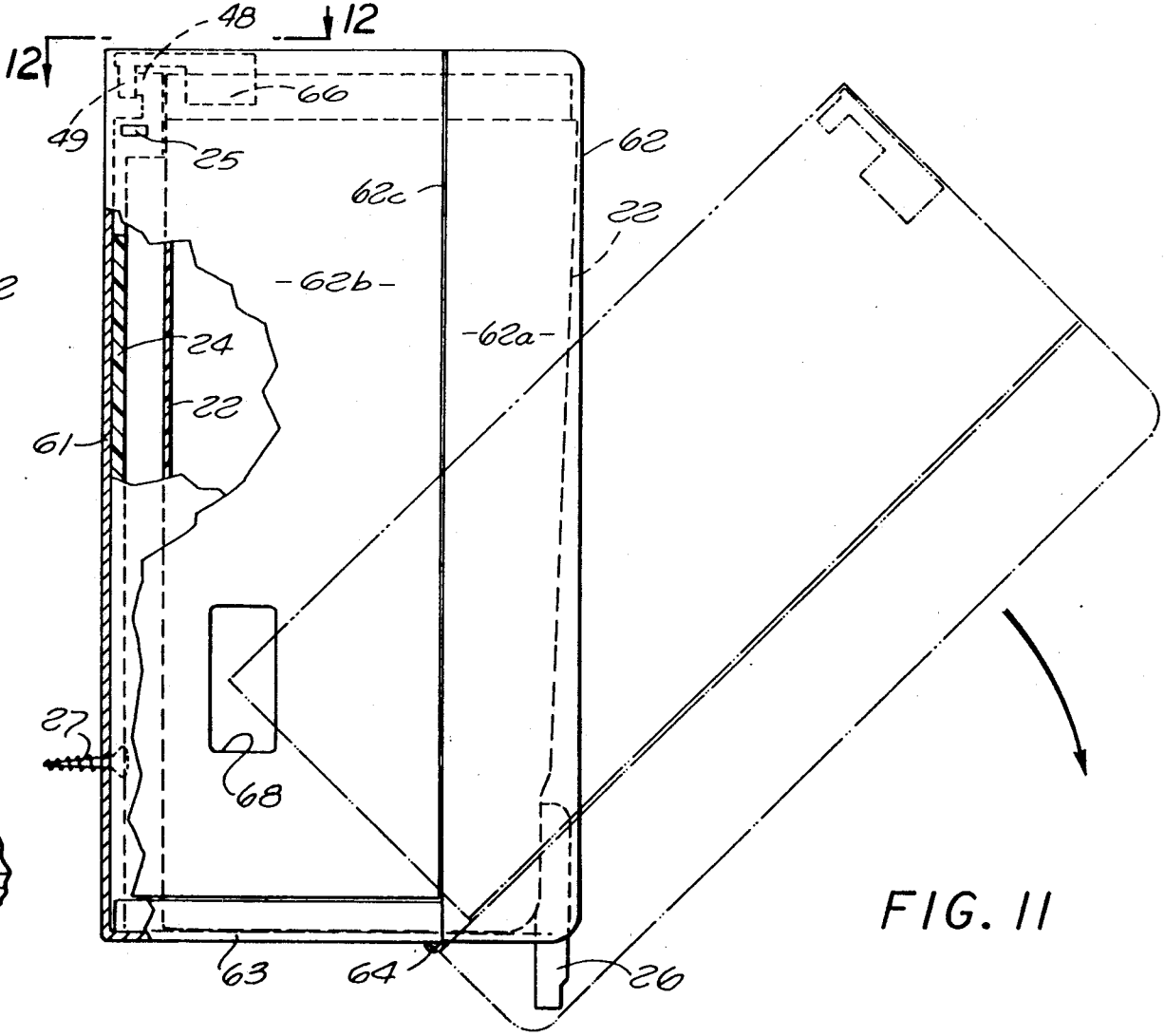
FIG. 11 is a side view of an alternative embodiment of the invention.
Figure 12:
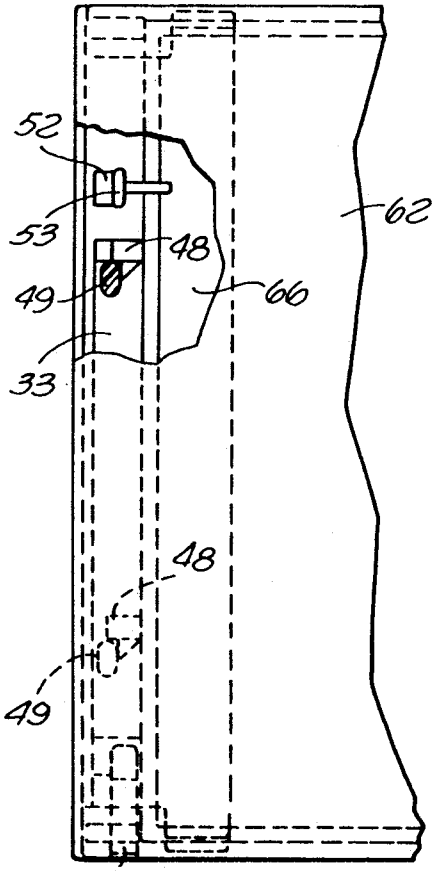
FIG. 12 is a partial top view taken along the line 12—12 of FIG. 11.

In the embodiment of FIGS. 11 and 12, components corresponding to those of the embodiment of FIGS. 1–10 are identified by the same reference numbers. The dispenser includes the container 22, the mounting bracket 24, an L shaped mounting plate 61, a cover 62 and the optional key 25. The container is mounted on the bracket 24 which is attached to the mounting plate 61 and the wall 21. The cover is pivoted on a base 63 of the bracket by hinges 64. Typically the cover 62 is formed of two sheet metal sections **62*a*, 62*b* joined at a seam 62*c*. A viewing opening 68** may be provided in the cover if desired.

The cover pivots from a closed position as shown in solid lines to an open position as shown in phantom lines. When the cover is open, the container can be filled.

The latch 33 is carried on the mounting bracket 24, as in the embodiment of FIGS. 1–10. The stop finger 37 of the latch and the latch pin 39 are not used.

The latch tabs 48 project upward from the cross bar of the latch and engage the lid or cover tabs 49 projecting downward from a locking strip 66 carried on the inner surface of the cover 62. When the cover is closed, the latch tabs 48 are in front of the cover tabs 49 and prevent pivoting movement of the cover.

When the latch is pivoted to the right, the latch tabs are moved away from the cover tabs. In the preferred construction, the latch tabs have a tapered or camming surface and the cover tabs also have a tapered or camming surface which enable the lid tabs to move the latch tabs to the right when the cover is pivoted upward to the closed position. When the lid tabs clear the latch tabs, the latch is pivoted back to the latched position by the action of the spring stem.

The lid or cover spring 52 is carried on the mounting bracket and preferably is formed integrally with the mounting bracket. The upper end of the cover spring engages a spring tab 53 of the cover. The lid spring functions as a pop-out spring for urging the cover away from the mounting bracket when the lid tabs are released from the latch tabs.

With this construction, a protective cover is provided for the container 22, while at the same time providing easy access to the container for refilling, cleaning or removal. While the two specific embodiments disclosed utilize fluid dispensers, various other containers for storage and/or dispensing a variety of products can be used with the mounting bracket.

I claim:

1. In a mounting system, the combination of:

a container;

a mounting bracket having a generally planar surface for attaching to a wall;

said container and bracket including first interengaging means for supporting said container on said bracket; and a releasable latch carried on said bracket;

said container and latch including second interengaging means, separate from said first interengaging means, for maintaining said container on said bracket and for releasing said latch from said container;

said first interengaging means including spaced wedges and correspondingly spaced wings with said wedges and wings converging downwardly and perpendicularly to said planar surface for positioning said container on said bracket both vertically and horizontally along a line perpendicular to said bracket planar surface, wherein said latch has a T shape with a stem and a coross bar at the upper end of said stem and with said latch joining said bracket at the lower end of said stem for movement of said latch relative to said bracket, with said stem including stem spring means for urging said latch to a latched position engaging said container.

2. A system as defined in claim 1 wherein said latch is formed integral with said bracket as a single component.

3. A system as defined in claim 1 including a lid for said container, said lid and bracket including third interengaging means for pivotally mounting said lid on said bracket, said lid and container including fourth interengaging means for holding said lid in a closed position on said container.

4. A system as defined in claim 3 wherein said third interengaging means includes pivot pin means on said lid and pivot slot means on said bracket for forward movement and upward pivoting of said lid relative to said bracket and container.

5. A system as defined in claim 4 with said bracket including lid spring means engaging said lid for urging said lid forward on said container to disengage said fourth interengaging means.

6. A system as defined in claim 5 wherein said latch and lid spring means are formed integral with said bracket as a single component.

7. In a mounting system, the combination of:

a container;
a mounting bracket;
said container and bracket including first interengaging means for supporting said container on said bracket; and
a releasable latch formed integral with said bracket as a single component;
said latch having a T shape with a stem and a cross bar at the upper end of said stem and with said latch joining said bracket at the lower end of said stem for movement of said latch relative to said bracket, with said stem including stem spring means for urging said latch to a latched position engaging said container;
said container and latch including second interengaging means, separate from said first interengaging means, for maintaining said container on said bracket and for releasing said latch from said container;
said first interengaging means including spaced wedges and correspondingly spaced wings with said wedges and wings converging downwardly for positioning said container on said bracket both vertically and horizontally along a line perpendicular to said bracket;
said second interengaging means including projecting latch pin means on said container and a pin engaging finger on said latch defining a notch for receiving said latch pin means, with said finger having a cam face for engagement by said latch pin means to move said latch laterally from said latched position.

8. In a mounting system, the combination of:
a container;
a mounting bracket;
said container and bracket including first interengaging means for supporting said container on said bracket;
a latch carried on said bracket;
said container and latch including second interengaging means for maintaining said container on said bracket;
said latch having a T shape with a stem and a cross bar at the upper end of said stem and joining said bracket at the lower end of said stem for movement of said latch relative to said bracket, with said stem including stem spring means for urging said latch to a latched position engaging said container,
said second interengaging means including projecting latch pin means on said container and a pin engaging finger on said latch defining a notch for receiving said latch pin means, with said finger having a cam face for engagement by said latch pin means to move said latch laterally from said latched position, and
a key positioned in said bracket for moving said latch away from said latched position for releasing said latch pin means from said notch.

9. In a mounting system, the combination of:
a container;
a mounting bracket;
said container and bracket including first interengaging means for supporting said container on said bracket; and
a latch carried on said bracket;
said container and latch including second interengaging means for maintaining said container on said bracket;
with said latch having a T shape with a stem and a cross bar at the upper end of said stem and with said latch joining said bracket at the lower end of said stem for movement of said latch relative to said bracket, with said stem including stem spring means for urging said latch to a latched position engaging said container; and further
including a lid for said container,
said lid and bracket including third interengaging means for pivotally mounting said lid on said bracket,
said lid and container including fourth interengaging means for holding said lid in a closed position on said container.

10. A system as defined in claim 9 wherein said third interengaging means includes pivot pin means on said lid and pivot slot means on said bracket for forward movement and upward pivoting of said lid relative to said bracket and container.

11. A system as defined in claim 10 with said bracket including lid spring means engaging said lid for urging said lid forward on said container to disengage said fourth interengaging means.

12. A system as defined in claim 11 wherein said lid spring means is formed integral with said bracket as a single component.

13. A system as defined in claim 12 wherein said fourth interengaging means includes lid lip means at the forward end of said lid and lid lip slots on said container for receiving said lid lip means.

14. A system as defined in claim 11 wherein said lid and bracket have fifth interengaging means for maintaining said lid in said closed position on said container when said latch is in said latched position.

15. A system as defined in claim 14 wherein said fifth interengaging means includes spaced lid tabs on said lid and spaced mating latch tabs on said latch, with at least one of said tabs having tapers at the interengaging surfaces for urging said lid rearward to said closed position.

16. In a mounting system, the combination of:
a container;
a mounting bracket;
said container and bracket including first interengaging means for supporting said container on said bracket;
a latch;
said container and latch including second interengaging means for maintaining said container on said bracket;
said latch having a T shape with a stem and a cross bar at the upper end of said stem and joining said bracket at the lower end of said stem for movement of said latch relative to said bracket, with said stem including stem spring means for urging said latch to a latched position engaging said container;
said second interengaging means includes projecting latch pin means on said container and a pin engaging finger on said latch defining a notch for receiving said latch pin means, with said finger having a cam face for engagement by said latch pin means to move said latch laterally from said latched position; and
a lid for said container;
said lid and bracket including third interengaging means for pivotally mounting said lid on said bracket and having pivot pin means on said lid and pivot slot means on said bracket for forward movement and upward pivoting of said lid relative to said bracket and container;

said lid and container including fourth interengaging means for holding said lid in a closed position on said container;

said bracket including lid spring means engaging said lid for urging said lid forward on said container to disengage said fourth interengaging means;

said lid and bracket having fifth interengaging means for maintaining said lid in said closed position on said container when said latch is in said latched position;

with said latch and lid spring means formed integral with said bracket as a single component.

17. In a mounting system, the combination of:

a container;

a mounting bracket;

said container and bracket including first interengaging means for supporting said container on said bracket;

a latch said container and latch including second interengaging means for maintaining said container on said bracket; and a lid for said container;

said lid and bracket including third interengaging means for pivotally mounting said lid on said bracket and having pivot pin means on said lid and pivot slot means on said bracket for forward movement and upward pivoting of said lid relative to said bracket and container.

18. A system as defined in claim 17 with said lid and container including fourth interengaging means for holding said lid in a closed position on said container, and with said lid and bracket having fifth interengaging means for maintaining said lid in said closed position on said container when said latch is in said latched position.

19. A system as defined in claim 18 with said latch formed integral with said bracket as a single component.

* * * * *